US006311629B1

(12) United States Patent
Marschner et al.

(10) Patent No.: US 6,311,629 B1
(45) **Date of Patent: *Nov. 6, 2001**

(54) PROCESS AND DEVICE FOR GASIFICATION OF WASTE

(75) Inventors: Siegmar Marschner, Dresden; Sven Halang, Freiberg, both of (DE)

(73) Assignee: Linde-KCA-Dresden-GmbH, Dresden (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/130,345

(22) Filed: Aug. 13, 1998

(30) Foreign Application Priority Data

Aug. 13, 1997 (DE) ..... 197 35 153

(51) Int. Cl.[7] ..... F23B 7/00; C10J 3/00; C10J 3/24

(52) U.S. Cl. ..... 110/341; 110/347; 110/346; 110/229; 110/266; 48/92; 48/198.2; 48/DIG. 1; 48/DIG. 2; 48/DIG. 4; 266/236; 266/900; 422/184.1

(58) Field of Search ..... 110/165 R, 229, 110/260, 261, 262, 263, 266, 346, 347, 341; 48/67, 92, 119, 198.2, DIG. 1, DIG. 2, DIG. 4; 266/195, 196, 230, 234, 236, 261, 286, 900; 588/201; 422/184.1

(56) References Cited

U.S. PATENT DOCUMENTS

| | | | | |
|---|---|---|---|---|
| 2,320,206 | * | 5/1943 | Engel et al. | 266/234 X |
| 3,790,145 | * | 2/1974 | Gering | 266/234 |
| 3,883,321 | * | 5/1975 | Haverkamp | 110/165 R X |
| 3,951,615 | * | 4/1976 | Gernhardt et al. | 110/229 X |
| 3,957,458 | * | 5/1976 | Squires | 110/165 R X |
| 4,033,562 | * | 7/1977 | Collin | 266/900 X |

(List continued on next page.)

FOREIGN PATENT DOCUMENTS

| | | | | |
|---|---|---|---|---|
| 196 29 544 | | 1/1998 | (DE) . | |
| 197 35 153 A1 | * | 2/1999 | (DE) | C10J/3/08 |
| 933481 | * | 8/1963 | (GB) | 110/165 R |
| 2 003 589 A | * | 3/1979 | (GB) | 110/229 |

OTHER PUBLICATIONS

Karl Joachim Thome–Kosmiensky, "Reaktoren zur themischen Abfallbehandlung", 1993, EF–Verlag fur Energie und Umwelttechnik GmbH, Berlin, pp. 1–2, 237–249.*

Franz Pawlek, "Metaallhuttenkunde" ["Metal Foundry Practice"], 1983, Walter de Gruyter, Berlin, pp. 28–41.*

P. Kozakevitch and G. Urbain, "Viskositat und Gefuge von Flussigen Schlacken" ["Viscosity and Structure of Liquid Slags" ], 1954, Metz, Freiberg, pp. 33–36, 128, 134, and various figures.*

*Primary Examiner*—Ira S. Lazarus
*Assistant Examiner*—Ljiljana V. Ciric
(74) *Attorney, Agent, or Firm*—Millen, White, Zelano & Branigan

(57) ABSTRACT

Gasification of waste is performed in a gasifier having a gasification space (1) and a liquid rotating slag bath (2). The slag bath (2) is preferably caused to rotate by tangentially injecting gasification medium and/or at least a portion of the waste via a burner toward the surface of the slag bath. Waste with a diameter of to 5 mm is preferably introduced into gasifier (1) above the slag bath (2), while larger waste is preferably introduced directly into the slag bath. Slag is a removed, together with cracked gas accumulated during gasification through the floor of the gasifier via a slag drain having a lateral opening which protrudes above the slag bath.

23 Claims, 4 Drawing Sheets

U.S. PATENT DOCUMENTS 4,162,655 * 7/1979 Bozdech et al. ..... 110/229 X
4,291,634 * 9/1981 Bergsten et al. ..... 110/229 X
4,518,417 * 5/1985 Lugscheider et al. .
4,574,714 * 3/1986 Bach et al. ..... 110/346 X
4,649,867 * 3/1987 Cordier et al. ..... 110/229 X
4,770,109 * 9/1988 Schlienger ..... 110/346 X
4,831,944 * 5/1989 Durand et al. ..... 110/346
4,981,285 * 1/1991 Agarwal et al. ..... 266/236 X
5,060,913 * 10/1991 Reid ..... 266/230 X
5,143,000 * 9/1992 Camacho ..... 110/229 X
5,461,991 * 10/1995 Wagner ..... 110/346
5,615,626 * 4/1997 Floyd et al. ..... 110/346
5,630,853 * 5/1997 Eales ..... 110/165 R X
5,685,244 * 11/1997 Goldfarb et al. ..... 110/346
5,700,144 * 12/1997 Schleimer et al. ..... 110/266 X
5,711,017 * 1/1998 Bitler et al. ..... 110/346 X
5,776,226 * 7/1998 Edlinger .

* cited by examiner

PROCESS AND DEVICE FOR GASIFICATION OF WASTE

SUMMARY OF INVENTION

It may be that in the future, waste with organic admixtures will no longer be disposed of in landfills. Therefore, to an increasing extent, waste is being subjected to thermal disposal in the form of burning (refuse incineration) or gasification.

For refuse incineration there are technically sophisticated processes which, with maximum efficiency for the generation of thermal and electrical energy, produce environmentally neutral by-products. This requires incineration parameters that ensure the production of slags that are highly resistant to having the heavy metals contained therein being leached out by water. It is also necessary to ensure that dust, nitrogen oxides, and dioxins/furans are extensively scrubbed out of the flue gases. Filter dust and processing water that are produced also need to be converted into environmentally neutral products at a reasonable cost. As a result, the technical costs involved in the environmentally neutral incineration of waste products are so high that only units with large throughput rates are able to work economically on waste.

Large throughput rates in turn require a large area from which to draw raw material to supply the requisite amount of waste. This causes the cost of shipping the waste from the point of origin to the incineration facility to become a non-negligible part of the overall costs.

As an alternative to incineration, waste can also be gasified with oxygen. Compared to incineration, gasification has a number of advantages:

a) Unlike incineration, gasification operates with an oxygen deficit. The main components in the gasification flue gas are therefore $H_2$, CO, and $CH_4$. Thus, the gasification flue gas can be used as a fuel gas. Sulfur turns into $H_2S$, which is comparatively easier to remove from the combustion gas than removing $SO_2$ from the flue gas of incineration. Also, no $NO_x$ is produced.

b) As a rule, gasification takes place at a higher temperature than incineration. This ensures that organic pollutants are more efficiently destroyed, the dioxin-furan problem is reliably solved, and heavy metals can be bonded into the slag to form compounds that cannot be eluted.

c) The amount of fuel gas used in incineration processes, relative to a standard state, is approximately one-tenth of the volume amount of flue gas generated by incineration. When gasification is carried out under pressure, the volume flow of the fuel gas amounts to even less than one percent of the volume flow of flue gas. This means that the equipment required to scrub the flue gas is kept relatively small, especially in comparison to incineration processes.

In making a cost comparison between incineration and gasification, the oxygen costs for gasification are a drawback.

Technically, gasification is performed in a fixed-bed pressure gasifier. This gasifier is combined with a slag reactor and is characterized by a relatively low oxygen demand. See, e.g., Thomé-Kozmiensky: Reaktoren zur thermischen Abfallbehandlung, EF-Verlag für Energie und Umwelttechnik GmbH, Berlin, 1993. Such a gasifier has the disadvantage, however, that large pieces of coal have to be added in order to create a support structure for the waste. In addition, the thermodynamically inherently favorable counter-current type of flow of waste and gasification gas builds up a pyrolysis zone in the gasifier shaft, so that the flue gas discharged from the fixed bed gasifier contains typical admixtures of a pyrolysis gas (pyrolysis oils, tars) that require expensive gas scrubbing.

The gasification of waste in an entrained bed is known as the Noell-KRC process. Here, the scrubbing of the gas is comparatively simple because, except for methane, the gas does not contain any hydrocarbons. Entrained-bed gasification requires, however, that the waste be ground up to a grain size of <0.5 mm.

In the Noell-KRC process, the actual entrained-bed gasifier is preceded by a pyrolysis drum. In this pyrolysis drum, waste that is only coarsely ground is converted into a pyrolysis gas, as well as an easily grindable pyrolysis coke. The pyrolysis gas and ground pyrolysis coke are then further decomposed in the entrained-bed gasifier. This upstream pyrolysis stage, the subsequent compression of the pyrolysis gas to the pressure of the entrained-bed gasifier, and the equipment required for cooling, grinding, intermediate storage, and proportioning of the pyrolysis coke are highly cost-intensive. An advantage of slag bath gasifiers is that such upstream pyrolysis drums are not necessary.

In the Thermoselect process, a pyrolysis stage also precedes gasification. In this case, the costs for preparing the waste for gasification are very low because the waste is pressed into the horizontal pyrolysis pit without any special pre-treatment.

To be sure, however, the gasification process can be run only at normal pressure because the pyrolysis pit does not ensure reliable sealing of the gas space. This makes the equipment required for gas scrubbing comparatively large and expensive.

In addition, the pyrolysis process in the pyrolysis pit is very incomplete, so that waste with sometimes very large dimensions drops into the gasification chamber uncontrolled and floats there on the slag. This makes the operation of the gasifier very irregular, leading to large variations in the amount and composition of the gasification flue gas and/or a highly variable oxygen demand. These large variations in the gasification flue gas make it difficult to use the gas. It is also difficult to compensate for the fluctuating oxygen demand.

An object of the invention is, therefore, to provide a process and a device for the gasification of waste that allow economical operation even at relatively low throughput rates.

Upon further study of the specification and appended claims, further objects and advantages of this invention will become apparent to those skilled in the art.

On the process side, these objects are accomplished according to the invention by virtue of the fact that gasification takes place in a single stage in a gasifier with a liquid, rotating slag bath.

This makes it possible to have smaller, decentralized plants, thereby reducing the costs for transporting waste.

The process according to the invention is characterized by a single-stage gasification process by which feed waste material is converted into a usable fuel gas and a slag granulate that can be disposed of in a landfill. Expensive pre-treatment of the feed material is not required.

The feed material can be fed into the gasifier with grain sizes of up to 40 mm, so that only coarse crushing of the waste is required in advance. The mixture is divided by screening, for example, into the following fractions:

d=0–5 mm d=5–40 mm d>40 mm.

The overflow from the screen is fed to a mill and then recycled to the screening machine.

A magnetic separator can be installed upstream of the gasifier to remove iron components.

The liquid slag bath, located in the gasification zone, performs a number of functions. Mineral components and heavy metals in the feed material are melted down and adsorbed. At the same time the slag bath acts as a heat buffer and reaction mediator and thus ensures an intensive exchange of heat and material.

An important function is the reliable ignition and, optionally, re-ignition of the burners, to provide the desired reaction temperature.

According to a preferred embodiment of the invention, excess slag is removed by a slag drain along with the cracked gas that accumulates during gasification. The slag drain protrudes above the slag bath, and the slag flows down into it through a lateral discharge opening.

The slag bath is preferably caused to rotate by tangentially feeding in the gasification medium and/or at least a portion of the waste. It is advantageous for at least a portion of the waste to be fed to the gasifier in the form of pellets via at least one solid burner, with recycled cracked gas as a carrier gas. In this case waste with a diameter of up to 5 mm is fed into the gasifier above the slag bath, and a jet of this waste is formed and aimed at the surface of the slag bath, while waste with a diameter of 5 to 40 mm is introduced directly into the slag bath.

Preferably, at least one gas burner is used that is supplied with oxygen as well as with natural gas during start-up and with recycled cracked gas during operation. In addition, it is advantageous for oxygen to be injected via one or more oxygen lances directly into the slag bath.

According to an enhancement of the concept of the invention, sand, lime, and/or other materials are fed into the slag bath in order to influence the melting behavior and viscosity of the slag.

Slag that is removed from the slag bath is preferably allowed to drip into a water bath and is converted there into a vitreous state that is not subject to elution.

When the gasifier is started, the slag bath is preferably formed by a synthetic slag.

An apparatus for implementing the process has means defining a gasification space, such as a covered reactor, for gasification of the waste.

On the apparatus side, the objects of the invention are accomplished by virtue of the fact that the gasification space has fittings for forming a rotating slag bath.

The reactor structure defining the gasification space preferably has an essentially cylindrical shape with a concentrically arranged slag drain that is lead through the bottom of the reactor structure.

The reactor jacket should be protected on the inside by a cooling shield preferably made of finned-tube coils which are welded together gas-tight and through which cooling water is forced. On the product (slag bath) side, the tubes are preferably provided with pins and packed with a ceramic tamping mass. A layer of slag cools solidly on this layer and forms a heat-insulating "slag coat", which protects the cooling shield against the high operating temperature and against direct attack by the liquid slag. The thickness of the slag protection layer depends on the operating conditions (temperature, slag composition).

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

In the figures the same parts are referred to by the same reference numbers.

Figure 1:
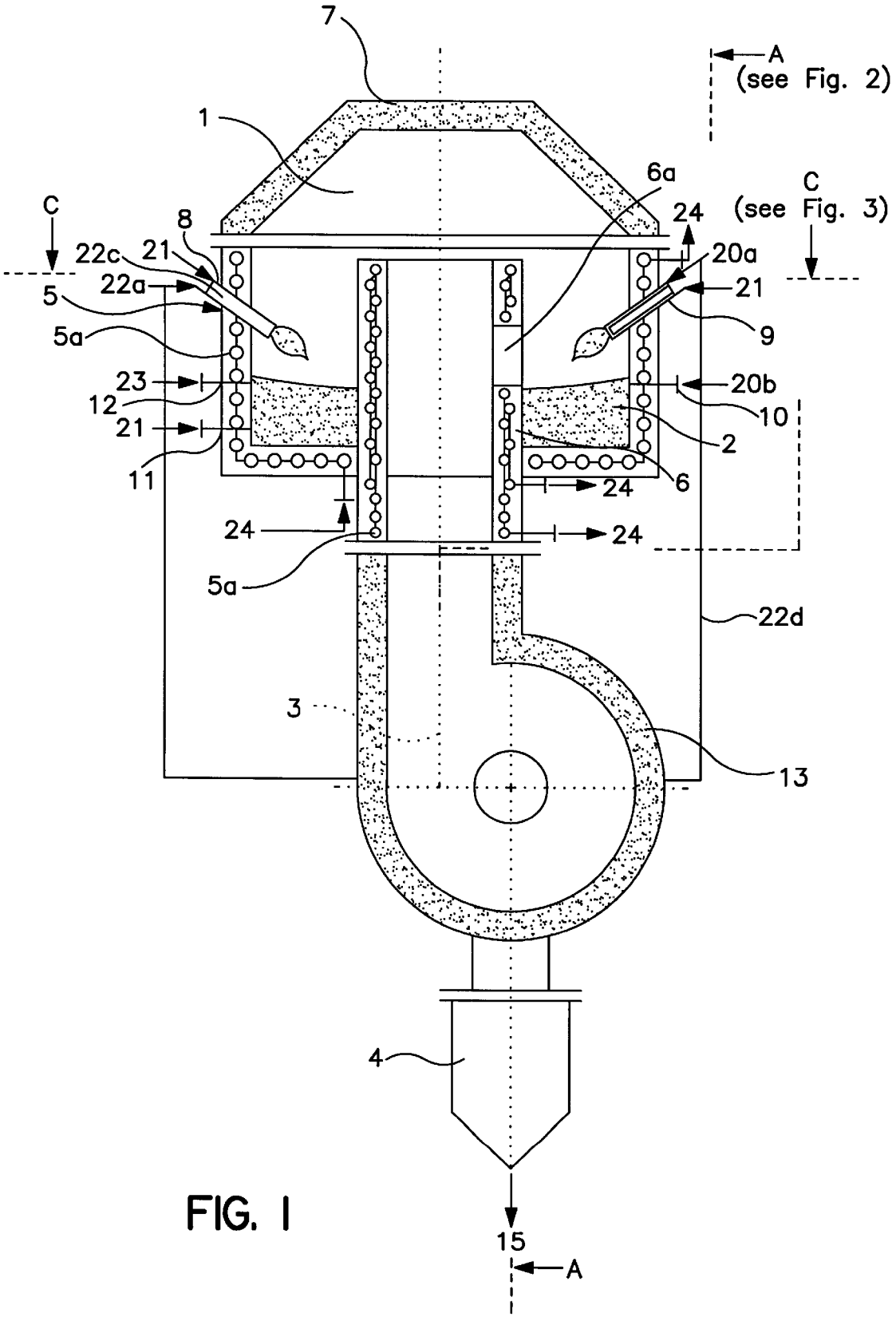
FIG. 1 illustrates a cross-section through a gasifier with a rotating slag bath.

The gasifier comprises a gasification space 1, that is formed by a reactor jacket 5 and a reactor cover 7. Reactor jacket 5 is protected by a cooling shield that is composed of finned-tube hoses 5*a* which are welded together gas-tight and through which cooling water is forced 24.

Since in the upward direction the gasifier is closed by cover 7, cracked gas that accumulates during gasification is only able to flow out of the gasifier, together with excess slag, through the slag drain formed by central tube 6.

Figure 4:
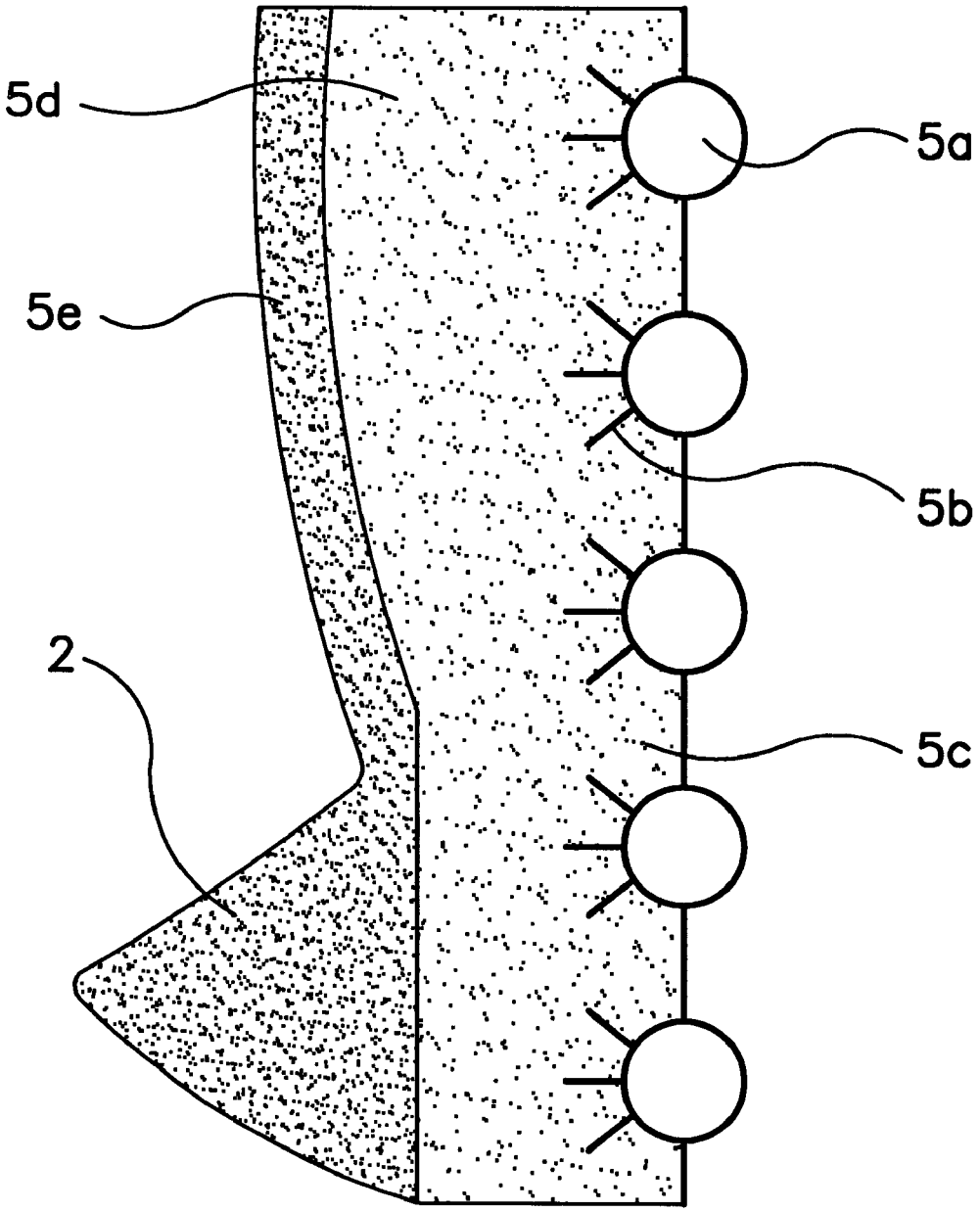
FIG. 4 illustrates the finned-tube coils with pins and the slag bath.

The gas outlet in the lower part of the gasifier, via central tube 6, ensures internal circulation of the accumulated cracked gas. Swirling of the gas evens out the dwell time and thus ensures a more complete establishment of equilibrium. Slag droplets that are entrained with the swirling cracked gas precipitate, for the most part, on the gasifier wall and flow off the wall into slag bath 2. See reference numeral 5*e* in FIG. 4.

Figure 3:
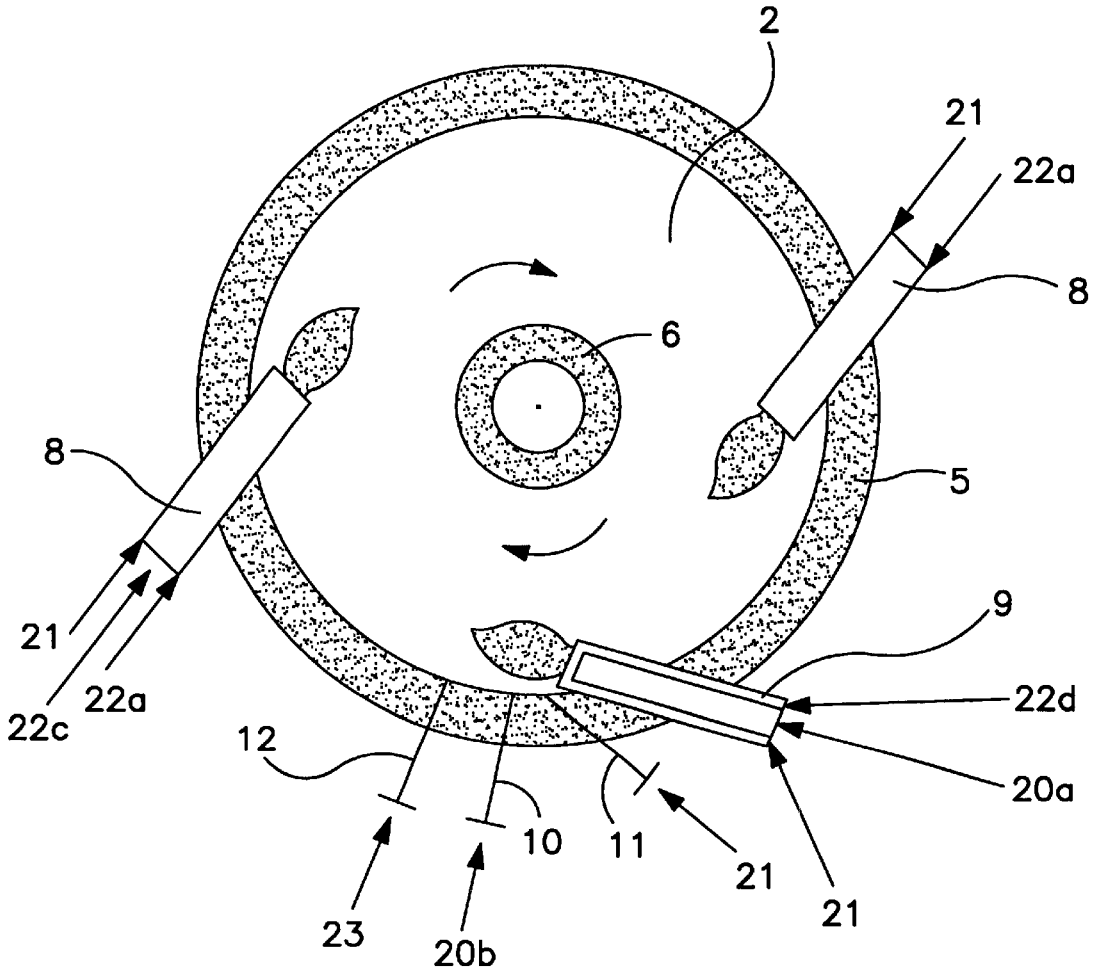
FIG. 3 illustrates a cross section through the gasifier showing tangential arrangement of the burners.

To feed the feed material and gasification medium into gasification space 1, two types of burners, 8 and 9, are used that are oriented obliquely downward, tangential to the surface of the slag bath. For example, the burners can be oriented at an angle of about 30°–60° with respect to the horizontal. The linear momentum that is transferred causes the slag to rotate, thus ensuring thorough mixing of slag bath 2. See FIG. 3.

During the start-up phase, natural gas 22*a* is burned in gas burners 8. During operation, recycled cracked gas 22*a* with oxygen (if necessary, with the addition of steam) is burned in gas burners 8. Steam can be added to provide adjustment of process temperature.

In solids burners 9, the fine-grain fraction (d<5 mm) of the feed waste material 20*a* is burned with oxygen 21, in which process recycled cracked gas acts as a carrier gas. Small particles are converted in the gas space above slag bath 2 in an entrained-bed gasification process. Because of the longer reaction time that is required, larger particles have time to hit the slag and sink into it. The coarse-grain fraction (d=5–40 mm) of the feed material 20*b* is fed directly into slag bath 2 by means of a proportioning screw via a radially arranged nozzle 10.

The intensive transfer of heat and material ensures the reliable gasification of the organic components, while the mineral components are melted down and absorbed by the slag.

Only a portion of the required oxygen is fed with the burners. The rest passes through tangentially arranged oxygen lances 11 directly into slag bath 2; this offers a number of advantages.

The direct injection ensures intensive and thorough mixing of the slag bath since, on the one hand, the linear momentum is transferred better and, on the other hand, the rising oxygen bubbles provide additional turbulence.

In addition, the oxygen makes it possible to gasify in the slag bath the organic components that are introduced into the slag, thereby, on the one hand, accelerating the gasification reaction and, on the other, reducing the number of crystal nuclei, which increase the viscosity of the slag.

When the device is started up, the slag bath should be formed by a synthetic slag ($CaO+SiO_2+Al_2O_3$). To this are added lime and sand at a lime:sand ratio of approximately 0.8 to approximately 1.2, as well as a smaller proportion of $Al_2O_3$ (approximately 10 wt % based on the total weight), whereby the latter are dumped into the reactor. During start-up, the mixture is melted down by the combustion of the natural gas injected into the burners and is thereby brought up to operating temperature.

While the gasifier is in operation, the slag bath is constantly replenished with mineral components that are brought in with the waste.

The properties of the slag (melting point, viscosity) are determined by its composition. Main components of the slag are CaO, $SiO_2$, and $Al_2O_3$. Other slag components are metals and their oxides that are brought in with the waste. Together with the slag components, they form eutectics whose melting points lie considerably below those of the individual components (see Pawlek; Metallhüttenkunde [Metal Foundry Practice], Walter de Gruyter (1983)).

An important parameter of the operation of the slag bath gasifier is the viscosity of the slag. Silicic acid is formed by $SiO_4$ tetrahedra whose centers contain a Si atom surrounded by four O atoms. Because of common oxygen atoms, these tetrahedra form space lattices which also remain in the liquid state as coherent complexes. The limited mobility of these large structures ensures high viscosity. The $Al^{3+}$ cations can substitute the $Si^{4+}$ cations and form $AlO_4$ tetrahedra. Thus, $Al_2O_3$ has an effect on the viscosity of slag that is similar to that of $SiO_2$. $SiO_2$ and $Al_2O_3$ are so-called network co-formers (see Kozakevitch, Urgain; Viscosität und Gefüge von flüssigen Schlacken [Viscosity and Structure of Liquid Slags], Metz 1954).

So-called network co-formers, such as CaO and MgO, are capable of breaking the tetrahedral bonds of the oxygen atoms and thus cause a reduction in the viscosity of the slag.

In the range of $CaO/SiO_2$=0.8–1.2, the $CaO\text{-}SiO_2$ system is sufficiently liquid at temperatures above 1450° C. Via a radially arranged nozzle 12 above slag bath 2, materials 23 such as sand and/or lime can be added to the slag, so that the melting and viscosity behavior of the slag can be influenced within certain limits.

To the same extent as slag-forming components are fed to slag bath 2, excess slag flows off via slag drain 6. According to the invention, the drain tube 6 protrudes above slag bath 2 and has a drain opening 6*a* at the desired height. Compared to a design where the slag overflow has a drip edge, this design according to the invention creates a concentrated, thicker jet of slag, thereby keeping strands from forming. Slag drain 6 is built as the crucible structure composed of finned-tube coils 5*a* that are welded together and cooled with pressurized water 24. These tubes 5*a* are provided with pins 5*b* on both sides and are packed with a ceramic tamping mass 5*c*. A layer of slag cools solidly 5*d* on this layer and protects the material against the high operating temperature and against direct attack by the chemically aggressive slag. See FIG. 4.

Because slag and hot cracked gas are tapped off together, the slag is kept liquid by the high temperatures of the gas.

The rest of the removal process takes place via the post-reaction space 13. This space may be designed as, e.g., a pot furnace or, as shown in FIG. 1, as a cyclonic furnace. In the latter the slag is refined, so that any foaming that may occur will not impede removal. In the event that temperatures in cyclonic furnace 3 are not sufficient to allow the slag to flow freely, a burner 14, shown in FIG. 2, that is operated with recycled cracked gas 22*d* and oxygen may be installed.

Before the product gas leaves the gasifier, carbon-containing particles that are not converted in the gasification zone may undergo further conversion in the post-gasification zone.

In the case of the cyclonic-type design, slag droplets and solid particles that are entrained with the cracked gas are deposited on the walls, thus significantly reducing the removal of entrained flue dust.

Figure 2:
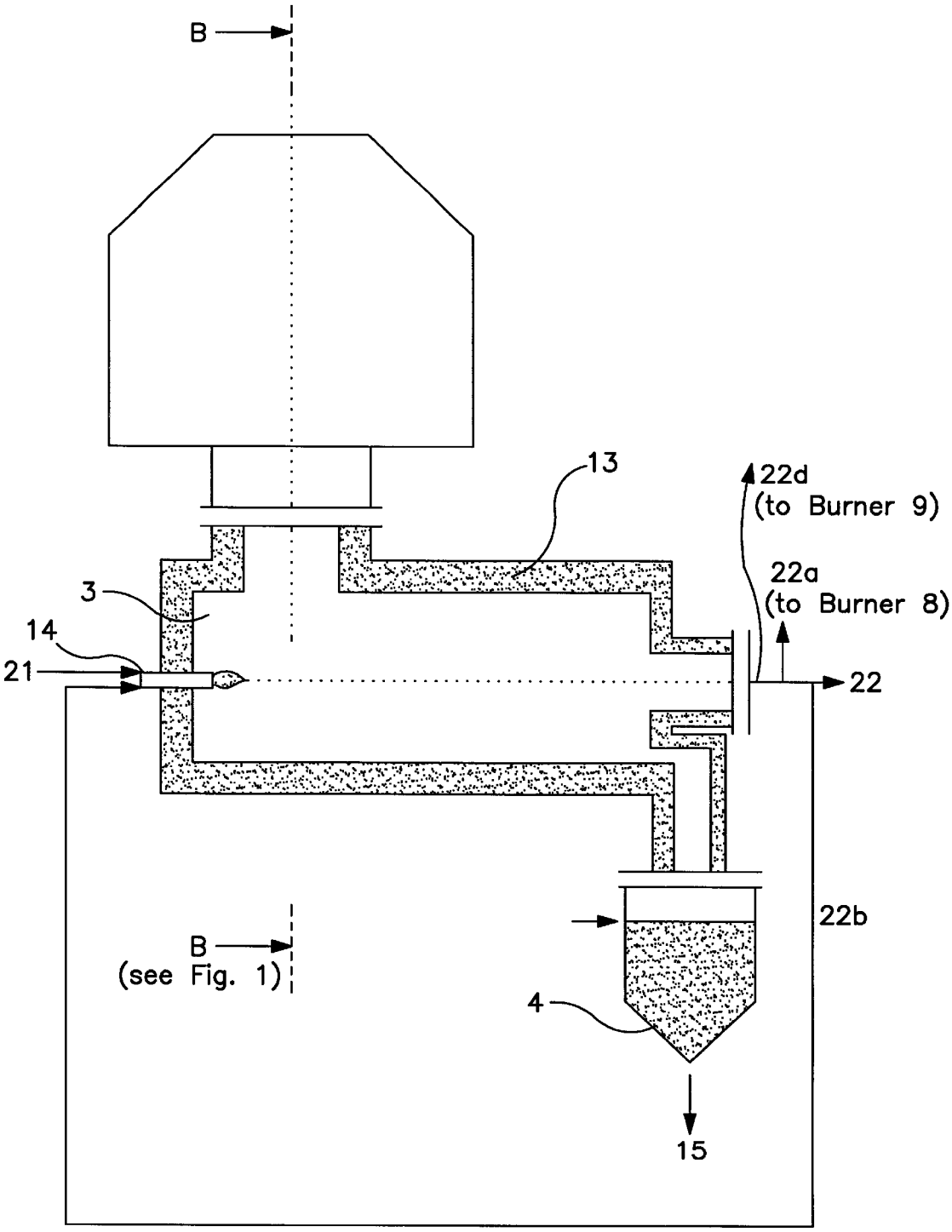
FIG. 2 illustrates a longitudinal section through the gasifier depicted in FIG. 1.

As shown in FIG. 2, a water bath 4 is attached to the post-reaction space to granulate the slag. The slag granulate 15 cannot be eluted and may be disposed of in landfills without restrictions.

If enough is spent on hardware, it is possible to operate the gasifier according to the invention under elevated pressure.

The gasifier according to the invention can be used advantageously for a broad range of waste materials.

Below two sample applications are described in greater detail.

The working temperature of the slag bath gasifier is set at 1600° C. Waste gasification is carried out as an autothermal process, in which case the amount of heat that is required to cleave the waste as well as to melt the mineral components is generated by partial oxidation of the combustible components with oxygen.

In the foregoing and in the following examples, all temperatures are set forth uncorrected in degrees Celcius; and, unless otherwise indicated, all parts and percentages are by weight.

The entire disclosure of all applications, patents and publications, cited above and below, and of corresponding German Application No. 19735153.0 filed Aug. 13, 1997 is hereby incorporated by reference.

EXAMPLES

Example 1

Refuse Incineration

Table 1 shows the composition of a standard refuse according to the Land Environmental Department of North Rhine-Westphalia.

The pre-treatment of the refuse is limited to the coarse crushing of the feed material to a grain size of less than 40 mm. Iron may also be removed by magnetic separation.

The 0–5 mm grain fraction is fed into the gasification space via the solids burners, while the 5–40 mm grain fraction is fed in via a nozzle by means of feed screws.

TABLE 1

Composition of a Standard Refuse According to the Land Environmental Department of North Rhine-Westphalia.

| Refuse Components | Mass-% | Ash Component | kg/t of Refuse |
|---|---|---|---|
| C | 27.16 | $SiO_2$ | 110 |
| H | 3.45 | $Al_2O_3$ | 34 |
| O | 18.39 | CaO | 31 |

TABLE 1-continued

Composition of a Standard Refuse According to the Land Environmental Department of North Rhine-Westphalia.

| Refuse Components | Mass-% | Ash Component | kg/t of Refuse |
|---|---|---|---|
| N | 0.3 | Fe | 30 |
| S | 0.5 | $Na_2O$ | 15.205 |
| Cl | 0.5 | $Fe_2O_3$ | 15 |
| Moisture ($H_2O$) | 25 | MgO | 4.5 |
| Ash | 25 | Al | 4 |
| | | $K_2O$ | 3 |

As Table 3 indicates, 357 $m^3_{i.N.}$ [i.N.=in normal state] of oxygen (96 vol-% of $O_2$) is used for the autothermal gasification of 1.0 ton of refuse.

Owing to the moisture content of the feed material, the cracked gas that is obtained has a large proportion of vapor. In addition, the cracked gas has large CO and $H_2$ contents, so that sufficient energy reserves are available to cover any higher heat losses that may occur.

The ash from the refuse has high contents of $SiO_2$ and $Al_2O_3$, which make the slag highly viscous. If this causes operating problems, the viscosity of the slag can be reduced by feeding in lime via a nozzle.

Example 2

Gasification of Old PVC

An advantageous application of the slag bath gasifier according to the invention is the gasification of waste PVC since, in addition to refuse disposal, the HCl contained in the PVC can be recovered and used as HCl gas in oxychlorination and ultimately to produce PVC again.

Table 2 presents the composition of a PVC-containing waste mixture.

TABLE 2

Waste Mixture with a High PVC Content

| Component | Mass-% |
|---|---|
| Pure PVC | 61 |
| Softener | 20 |
| Chalk | 8.6 |
| Combustible waste | 6.4 |
| Non-combustible waste | 4 |

In addition to screening with corresponding crushing of the waste PVC to a grain size of d<40 mm and the magnetic separator for removing iron, an additional air separator (zigzag separator) should be provided for the pre-treatment process. In the latter separator, heavy non-ferrous metals are separated which, in the slag bath, are converted into metal chloride for the most part and thus would reduce the HCl yield. By contrast, the silicates and light metals (Al, Mg) are desired slag formers.

The option of using relatively coarse-grain feed material is especially economical in the case of PVC because this means that crushing in a cutting mill is sufficient and it is no longer necessary to carry out low-temperature grinding, which is cumbersome and very cost-intensive.

The d=0–5 mm grain fraction is fed into the gasification space via the solids burners, while the d=5–40 mm grain fraction is fed in via a nozzle by means of feed screws.

Table 3 shows that an oxygen demand of 420 $m^3_{i.N.}$ per ton of waste PVC is used for autothermal gasification of waste PVC.

An almost 100% HCl yield is obtained. The HCl is recovered from the cracked gas via subsequent absorption and distillation and sent for further processing. The formation of metal chlorides in the slag bath may reduce the HCl yield. Injecting oxygen directly into the slag bath creates an oxygen surplus in the slag; this causes the formation of metal chlorides by the slag components to be suppressed or metal chlorides to be oxidized with $Cl_2$ cleavage, to the extent that the tendency of the elements toward oxidation predominates over that towards chlorination (compare free reaction enthalpy).

$$MeCl_2+\tfrac{1}{2}O_2 \rightarrow MeO+\tfrac{1}{2}Cl_2$$

The HCl-free cracked gas is rich in CO and $H_2$ and can be used to produce electrical energy and process steam.

The chalk that is contained in the old PVC is cleaved into $CO_2$ and CaO in the slag bath, so that it may be necessary to add sand to the slag.

TABLE 3

Balancing for Cracked Gas of Waste Materials in the Slag Bath Gasifier (T = 1600° C., $Q_v$ = 0).

| Waste | Oxygen Demand (96 vol-% of O) $m^3_{i.N}/^t$ | Amount of Cracked Gas $m^3_{i.N}/^t$ | Composition of Cracked Gas HCl | $H_2$ | $H_2O$ | CO | $CO_2$ | $N_2$ |
|---|---|---|---|---|---|---|---|---|
| | | | Vol.-% | | | | | |
| Refuse | 357 | 1230 | 0 | 13.7 | 42.6 | 23.6 | 17.5 | 1.3 |
| (NRW) Old PVC | 422 | 1531 | 14.4 | 27.1 | 1.4 | 55.2 | 0.7 | 1.1 |

The two examples given with wastes of very different compositions show that, from the standpoint of the energy budget, gasification with oxygen in the slag bath can act on a large variety of types of waste without major problems.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

We claim:

1. A process for gasification of waste, comprising:

introducing waste into a single stage gasifier having a gasification space (1), wherein said gasifier contains a liquid rotating slag bath (2), performing gasification of said waste in said gasifier and accumulating cracked gas formed during gasification, and removing slag from said gasifier, together with cracked gas accumulated during gasification, via a slag drain having a lateral drain opening (6), wherein said slag drain protrudes above said slag bath (2) and slag flows into said slag drain via said lateral drain opening, wherein a first portion of waste substances is introduced above said slag bath and is directed toward the surface of said slag bath, and a second portion of waste substances is introduced directly into said slag bath.

2. A process according to claim 1, wherein said slag bath (2) is caused to rotate by tangentially injecting, into said single stage gasifier, (a) a gasification medium, (b) at least a portion of the waste, or (c) both a gasification medium and at least a portion of the waste.

3. A process according to claim 1, wherein said slag bath (2) is caused to rotate by tangentially injecting, into said single stage gasifier, (a) a gasification medium, (b) at least a portion of the waste, or (c) both a gasification medium and at least a portion of the waste.

4. A process according to claim 3, wherein said first portion of waste substances contains relatively fine-grained waste and said second portion of waste substance contains relatively coarse-grained waste, and said first portion of waste is fed into said gasifier, with recycled cracked gas as a carrier gas, via at least one solids burner (9).

5. A process according to claim 1, wherein said first portion of waste substances contains relatively fine-grained waste and said second portion of waste substance contains relatively coarse-grained waste, and said first portion of waste is fed into said gasifier, with recycled cracked gas as a carrier gas, via at least one solids burner (9).

6. A process according to claim 5, wherein at least one gas burner (8), fed with oxygen and natural gas, is used during start-up, and, during operation, said at least one gas burner (8) is fed with recycled cracked gas.

7. A process according to claim 5, wherein during operation at least one gas burner (8) is fed with recycled cracked gas and oxygen.

8. A process according to claim 1, wherein said first portion of waste is fed into said gasifier, with recycled cracked gas as a carrier gas, via at least one solids burner (9).

9. A process according to claim 1, wherein said first portion of waste substances contains relatively fine-grained waste having a diameter of up to 5 mm and said second portion of waste substance contains relatively coarse-grained waste having a diameter of 5–40 mm.

10. A process according to claim 1, wherein at least one gas burner (8), fed with oxygen and natural gas, is used during start-up, and, during operation, said at least one gas burner (8) is fed with recycled cracked gas.

11. A process according to claim 1, further comprising injecting oxygen directly into said slag bath (2) via at least one oxygen lance.

12. A process according to claim 1, further comprising feeding materials into said slag bath (2) to influence melting behavior and viscosity of said slag.

13. A process according to claim 1, further comprising dropping slag removed from said gasifier into a water bath (4) and converting the slag dropped in said water bath into a vitreous state.

14. A process according to claim 1, wherein, when starting up said process, the gasifier is provided with a slag comprising CaO, $SiO_2$, and $Al_2O_3$.

15. A process according to claim 1, wherein during operation at least one gas burner (8) is fed with recycled cracked gas and oxygen.

16. A process according to claim 1, wherein said slag comprises CaO, $SiO_2$, and $Al_2O_3$.

17. An apparatus for gasification of waste comprising:

a gasifier defining a gasification space (1) and at least one burner oriented tangentially with respect to an internal wall of the gasifier, whereby introduction of waste material, gasification medium, or both, through said at least one burner provides rotation of a slag bath (2) within said gasifier, wherein said gasifier has an essentially cylindrical shape with a floor, said gasifier further comprising a slag drain (6) through said floor of said gasifier, said slag drain being concentrically arranged with respect to the axis of said gasifier, and said apparatus further comprising a cyclonic furnace (3) defining a post-gasification space, which is in fluid communication with said gasifier, into which slag droplets and flue dust, entrained with cracked gas are precipitated.

18. An apparatus according to claim 17, wherein said gasifier and slag drain (6) are formed from finned-tube coils which are welded together gas-tight and packed with a ceramic tamping clay.

19. A device according to claim 15, further comprising a supplementary burner (14) installed in said cyclonic furnace (3), and a conduit for recycling cracked gas accumulated in said gasifier to said supplementary burner (14).

20. An apparatus according to claim 17, wherein said at least one burner oriented tangentially with respect to the internal wall of the gasifier is also oriented at an angle of 30°–60° with respect to the horizontal.

21. An apparatus according to claim 17, wherein said gasifier further comprises a radially positioned nozzle for introducing waste directly into said slag bath.

22. An apparatus according to claim 17, wherein said gasifier contains a slag comprising CaO, $SiO_2$, and $Al_2O_3$.

23. An apparatus according to claim 17, wherein said at least one burner tangentially injects, into said gasifier, (a) a gasification medium, (b) waste particles, or (c) both a gasification medium and waste particles, and said gasifier further comprises a cover which closes the top of the gasifier.

* * * * *